US005795595A

United States Patent [19]

Beeck et al.

[11] Patent Number: 5,795,595

[45] Date of Patent: Aug. 18, 1998

[54] SPINNING PACK WITH SAND FILTER

[75] Inventors: Heinz-Dieter Beeck, Frankfurt am Main; Bernd Kretschmann, Alzenau; Wilhelm Sprick, Bockenem, all of Germany

[73] Assignee: Zimmer Aktiengesellschaft, Germany

[21] Appl. No.: 698,684

[22] Filed: Sep. 9, 1996

[30] Foreign Application Priority Data

Feb. 24, 1996 [DE] Germany ..... 196 07 103.8

[51] Int. Cl.[6] ..... D01D 4/06

[52] U.S. Cl. ..... 425/198; 425/72.2; 425/199; 425/382.2

[58] Field of Search ..... 425/192 S, 197, 425/198, 199, 382.2, 72.2, 464

[56] References Cited

U.S. PATENT DOCUMENTS

| | | | |
|---|---|---|---|
| 3,888,963 | 6/1975 | Orso et al. | 264/176 R |
| 4,493,628 | 1/1985 | Lenk | 425/192 |
| 4,645,444 | 2/1987 | Lenk et al. | 425/192 S |
| 4,681,522 | 7/1987 | Lenk | 425/72 S |
| 4,704,077 | 11/1987 | Lenk | 425/131.5 |
| 5,035,595 | 7/1991 | Nakajima et al. | 425/131.5 |
| 5,346,303 | 9/1994 | Starnes, Jr. | 425/197 |
| 5,562,930 | 10/1996 | Hills | 425/198 |

*Primary Examiner*—Jay H. Woo
*Assistant Examiner*—Iurie Schwartz
*Attorney, Agent, or Firm*—McDonnell Boehnen Hulbert & Berghoff

[57] ABSTRACT

A spinning pack with a sand filter for the melt spinning of thermoplastics, whereby at least one perforated plate with evenly distributed D-shaped holes with slanting openings that taper conically in the direction of flow is placed in the direction of flow in front of and/or behind the sand filter. Spinning packs according to the invention surprisingly give highly uniform distribution and flow of thermoplastic melt through the sand filter.

9 Claims, 2 Drawing Sheets

SPINNING PACK WITH SAND FILTER

BACKGROUND OF THE INVENTION

1. Field of the Invention

The invention relates to the field of spinning packs with sand filter for the melt spinning of thermoplastics.

2. Summary of the Related Art

Spinning packs with sand filters for processing of thermoplastic into fibers are known in the art (U.S. Pat. No. 3,028,627, 4,493,628 and 5,304,052, EP patent 0 387 470). In these processes, the thermoplastic melt being fed through the melt channel is passed through a bed of superfine sand before it exits through the die plate for filtration, shearing, and compression. In order to prevent the melt current from uncontrollably flushing away the sand filling and forming preferred currents, loose, simple screens or a distributor disc (EP disclosure publication 0 547 700) held by the cover plate are placed onto the packed sand. A metallic web or metallic fleece filter placed underneath the sand bed protects the nozzle capillary bores from being infiltrated by sand particles. To prevent pressure exerted by the melt from pressing the protective filter in the capillary bore holes, a 20–30 mm thick supporting plate with bore holes 2–3 mm in diameter is normally placed between the protective filter and the die plate.

Flow experiments have shown, however, that preference currents, uncontrolled lateral currents, and zones in which there is very little current or even no current at all develop in these spinning packs, both within the sand filter and directly in front of the die plate. The resulting differences in the polymer melt's dwell time in the spinning pack result in the polymer being subjected to fluctuating thermal loads that, in turn, deteriorate the quality of the polymer and the spun fibers. In addition, the uniformity of the fibers' capillary titer is compromised by the uneven distribution of the melt.

Consequently, the task of this invention is to modify state of the art spinning packs with sand filters so that the flow and distribution of polymer melt throughout the entire spinning pack and through the spinning die plate remain as uniform as possible.

SUMMARY OF THE INVENTION

The present invention solves the problems of flow and distribution in spinning packs by providing a new spinning pack. The spinning pack according to the invention includes at least one perforated plate with a plurality of evenly distributed, D-shaped holes having slanting openings tapering in the direction of flow. Such a plate is placed directly in front of and/or behind (defined by the direction of flow through the spinning pack) the sand filter with its metal protective filter. Surprisingly, it has been found that the use in spinning packs of the perforated plates according to the invention results in exceptionally even distribution and flow of polymer melt throughout the entire spinning pack and die plate. The degree of uniformity attained in this manner is vastly superior to the homogeneity achieved with perforated plates having round, cylindrical, or straight, slit-like openings.

The foregoing merely summarizes certain aspects of the invention and is not intended, nor should it be construed, as limiting the invention in any way. All patents and publications recited herein are hereby incorporated by reference in their entirety.

DETAILED DESCRIPTION OF THE PREFERRED EMBODIMENTS

Figure 1:
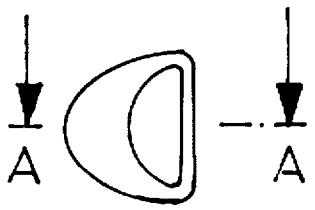
FIG. 1 depicts a top view (in the direction of flow) of a perforated plate opening according to the invention.

The present invention comprises an improved spinning pack with sand filter for melt spinning of thermoplastics. This spinning pack comprises a casing with a cover plate, a melt channel having a long axis in the direction of flow, a sand filter with a metal protective filter and a die plate, wherein a perforated plate with a plurality of evenly distributed, D-shaped holes with slanting openings tapering in the direction of melt flow is placed directly in front of and/or behind the sand filter with its metal protective filter.

As used herein, "front" means that side of an element of the spinning pack closest to the side into which the melt enters the pack and "back" or "behind" means that side closest to the side of the spinning pack from which the melt exits.

While the holes in traditional perforated plates are cut out of the plate so that the openings have identical profiles on the inflow and outflow sides, the holes in the plates of the invention are punched. Because of the design of the pressure stamp, the resulting holes are slanting and conical, as shown in the longitudinal section in FIG. 2. The metal is stretched when the holes are punched. The intensity of the distortion of the metal is proportional to the size of the tapering angle. Consequently, the holes are extended considerably beyond the original plate surface in the direction in which they are punched—which is identical to the polymer melt's direction of flow, as identified by the arrows in the drawing—on the bowed side of the D while they are extended slightly on the flat side of the D. This produces the slanting position of the holes' extrusion openings, which is a major factor in ensuring the uniform flow and distribution of polymer melt in the spinning pack. The resulting uneven surface of the perforated plate on the exit side is shown in perspective in FIG. 3. In addition, the stretching process solidifies the metal, so that the perforated plates can be much thinner than the customary support plates without the need to make any changes to the pressure level of the melt.

Figure 2:
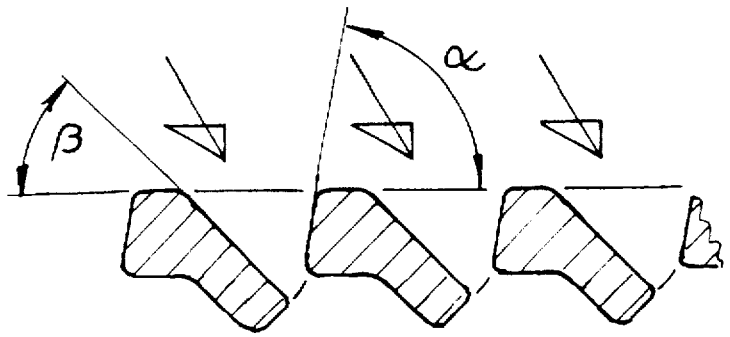
FIG. 2 depicts a longitudinal section taken along the line A—A of three perforated plate openings according to the invention. The open-headed arrows indicate the direction of polymer melt flow.
Figure 3:
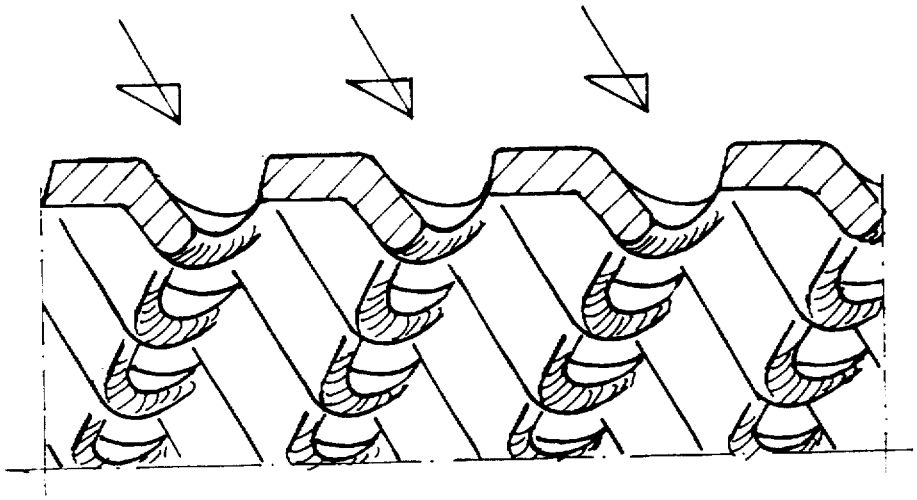
FIG. 3 depicts an angular perspective of the perforated plate according to the invention. The open-headed arrows indicate the direction of polymer melt flow.

The D-shaped holes' extrusion openings are further defined by two angles $\alpha$ and $\beta$. As depcited in FIG. 2, $\alpha$ is the acute angle between the surface of the tapered conical opening at the flat portion of the D and the front surface of the plate. Also as depicted in FIG. 2, $\beta$ is the acute angle between the surface of the tapered conical opening at the curved (or bowed) portion of the D and the front surface of the plate. The tapering angle $\alpha$ is considerably larger than the angle $\beta$.

FIG. 1 shows an enlargement of the D-shaped profile—in this case, a mirror image—of the perforated plate openings. These openings are much larger on the inflow side, particularly on the bowed side of the D, than they are on the outflow side.

The perforated plate of the invention, which is between 0.75 and 2.0 mm thick (preferably 1.0 to 1.5 mm thick), has tapered openings with an outflow diameter between 0.5 and 3.0 mm (preferably 0.8 to 1.25 mm) and an open outflow surface ranging from 9 to 24% (preferably 10 to 16%) of the total surface area of the plate. The tapering angle at the openings on the straight side of the D ($\alpha$) is 65 to 85° (preferably 75° to 80°) and, on the curved side of the D ($\beta$) is 40° to 60° (preferably 45° to 50°) at a gradual transition between ($\alpha$) and ($\beta$). In spinning packs that include two of the perforated plates described in the invention, the holes in both perforated plates may have either the same configuration, or the holes in the perforated plate located in front of the sand filter with a metal protective filter may have a larger outflow diameter than the holes in the perforated plate located beyond the sand filter.

The perforated plates are made of a metal with a similar composition to that used to make the spinning pack casing, preferably nickel chromium steel. This type of perforated plate is sold commercially for use in gas distributor plates, centrifugal screens, milling screens and similar devices, e.g., under the registered brand name CONIDUR, marketed by Hein and Lehmann, Separation and Conveyor Technology GmbH, D-47805 Krefeld-Oppum, Germany. Until now, however, its usefulness in spinning packs has not been appreciated and, accordingly, it has not been used in spinning packs.

Figure 4:
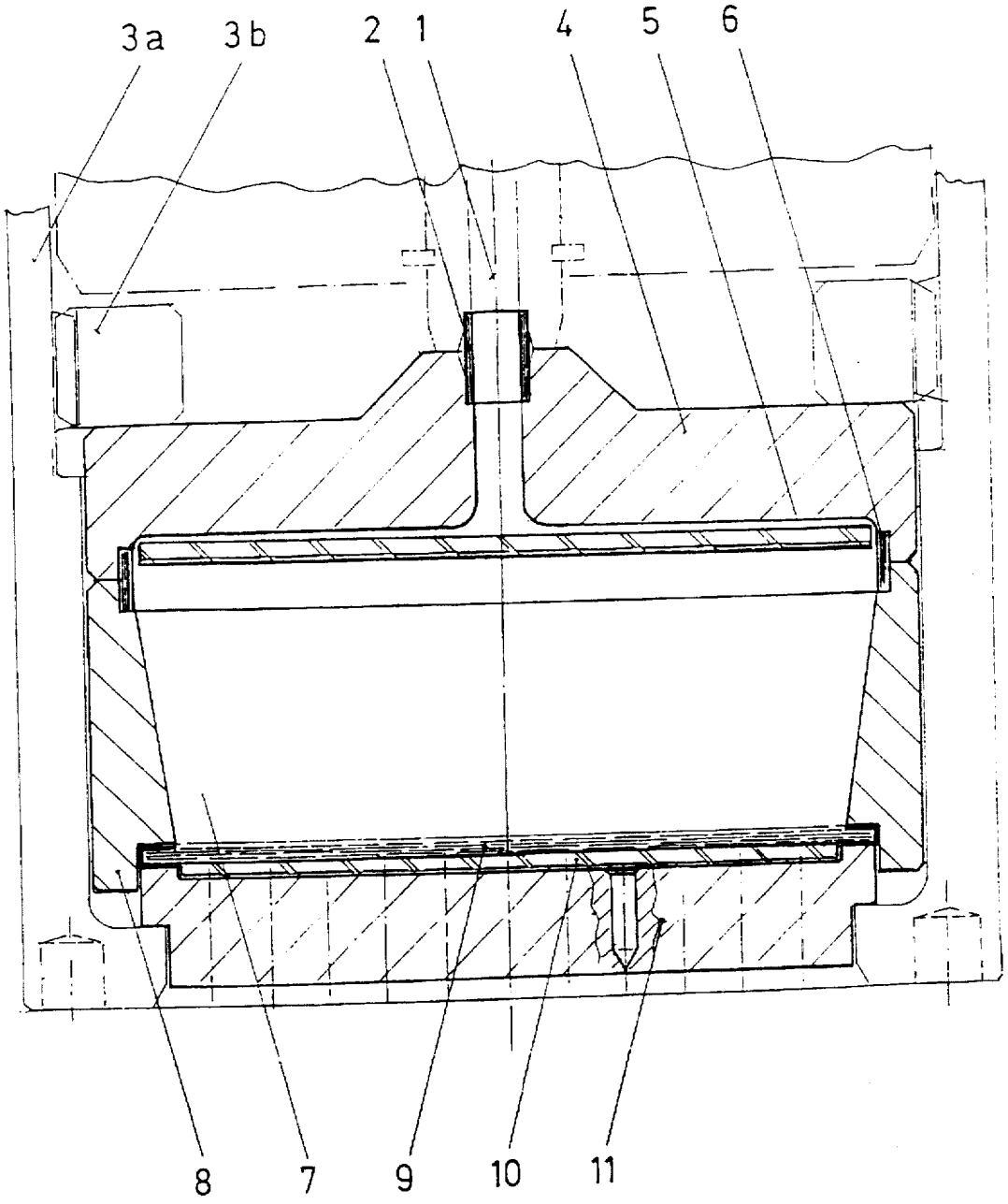
FIG. 4 depicts a longitudinal section of a spinning pack according to the invention.

FIG. 4 shows an example of a spinning pack that includes two of the perforated plates described in this invention. Those skilled in the art will appreciate that variations on the design of the spinning pack, particularly in the design of the casing, the cover plate and the sand jacket, can be made without violating the spirit or scope of the invention. The spinning pack is part of a spinning bar used to extrude thermoplastic melts during fiber production. The spinning pack shown in the FIG. 4 consists primarily of the casing (3*a*), the cover plate (4), which is held in place by a thrust collar (3*b*) screwed into the casing, the sand filter (7), which is enclosed by the sand jacket (8), a self-sealing metal protective filter (9), and the die plate (11). With the help of conventional spinning pumps, the polymer melt being spun is fed along the melt channel (1), through the cover plate (4), the sand filter (7), and, finally, the die plate (11). The bushing seals (2 and 6) are used to seal the melt channel at the upper and lower surfaces of the cover plate (4), the sides of which have been pulled down.

Two perforated plates are used in the spinning pack depicted in FIG. 4. One perforated plate (5) according to the invention is placed loosely onto the sand filter (7) directly underneath the cover plate (4) and within the bushing seal (6). This ensures that the polymer melt is distributed evenly across the entire profile of the sand filter (7) and that the sand cannot be washed away. An additional perforated plate (10) according to the invention is placed loosely into a corresponding groove in the die plate (11) directly underneath the protective filter (9). This ensures that the melt is distributed evenly to all nozzles in the die plate and prevents low-current zones from developing. As the protective plate normally used in this location (minimum thickness: 20 mm) and the corresponding seals are not needed, materials, weight and costs can be saved. In addition, this reduces the height of the spinning pack which, in turn, advantageously reduces polymer dwell time. Both perforated plates (5 and 10) are inserted loosely into the spinning pack and are only secured against lateral displacement by the bushing seal (6) and/or the groove in the die plate (11). In response to melt pressure, the perforated plate is pressed against the sand filter (7) and/or the die plate (11) during spinning. In other spinning pack designs, other methods may be used to mount or secure the invention-specific perforated plates laterally. In addition to the special shape of the holes openings of the perforated plate, it is important to note the placement of the plate in the direction of flow immediately in front of and/or behind the sand filter with metal protective filter. Of course, a more uniform melt distribution and flow can be achieved with two perforated plates, one on each side of the sand filter with metal protective filter, than with only one perforated plate placed in front of or, preferably, behind the sand filter with metal protective filter. The degree of homogeneity that can be achieved with only one perforated plate, however, is still considerably greater than that of a conventional spinning pack. Thus, a spinning pack according to the invention has a perforated plate described herein in front of the sand filter, or, preferably in back of the sand filter, or, most preferably, both in front and back of the sand filter.

Surprisingly, the use of the perforated plates described in this invention in spinning packs results in the exceptionally even distribution and flow of polymer melt throughout the entire spinning pack and through the die plate. The degree of uniformity attained in this manner is vastly superior to the homogeneity that can be achieved with perforated plates that have round openings, openings that are cylindrical in the direction of flow, or straight, slit-like openings. This highly uniform distribution and flow of the melt cannot even be achieved when multiple layers of filter material and flow distributor discs are used.

The following Example is provided for illustrative purposes only and is not intended, nor should it be construed, as limiting the invention in any way. Those skilled in the art will appreciate that variations of the specifically disclosed embodiments can be made without exceeding the spirit or scope of the invention.

EXAMPLE

Comparison of Melt Flow in Conventional Spinning Pack and a Spinning Pack of the Invention The superiority of the spinning pack according to the invention was demonstrated in a large number of spinning tests using two different colored silicon pastes containing hardening agents. The test was conducted as follows: After the first silicon paste had been spun, the second silicon paste was fed into the equipment. 30 seconds after the color changes became visible at the spinning nozzles, the flow core and sand were removed from the spinning pack and allowed to harden. Sample cuts taken from the hardened flow core were then evaluated visually. The samples taken from traditionally designed spinning packs showed evidence of conspicuous dead pockets underneath the cover plate, a noticeable current cone in the sand core, a current decrease underneath the filter holder, and pockets of the first color in the die bores and between the supporting plate and the die plate. In contrast, samples taken from the spinning pack described in this invention showed a surprisingly uniform flow throughout the entire spinning pack, with no dead pockets underneath the cover plate or pockets of the first color in the vicinity of the die plate.

We claim:

1. In a spinning pack for use with melt spinning thermoplastics comprising a casing with a cover plate and a melt channel having a longitudinal axis defining a direction of flow of the thermoplastics through the spinning pack, a sand filter with a metal protective filter, and a die plate, the sand filter having a front side into which the thermoplastic flows and a back side out from which the thermoplastic flows, the improvement comprising a perforated plate with a plurality of evenly distributed, punched, D-shaped, slanting holes having a flat side and a bowed side, with the slanting holes tapering conically in the direction of flow, wherein the exit side of the perforated plate is uneven as a result of punching, and wherein the perforated plate is present on the front side, or back side, or both sides of the filter.

2. The spinning pack according to claim 1, wherein the exit diameter of the conically tapered perforated plate openings is between 0.5 and 3.0 mm, and the open exit surface comprises 9 to 24% of the overall surface of the perforated plate.

3. The spinning pack according to claim 1, wherein the conically tapering perforated plate openings have a tapering angle $\alpha$ of 65° to 85°, wherein $\alpha$ is the acute angle between the surface of the tapered conical opening at the flat side of the D and the front surface of the plate, and a tapering angle $\beta$ of 40° to 60° with a gradual transition between $\alpha$ and $\beta$, wherein $\beta$ is the acute angle between the surface of the tapered conical opening at the bowed side of the D and the front surface of the plate.

4. A spinning pack according to claim 1, wherein the perforated plate has a thickness in the range of 0.75 to 2.0 mm.

5. A spinning pack according to claim 1, wherein a perforated plate is between the sand filter with metal protective filter and the die plate.

6. A spinning pack according to claim 1, wherein a perforated plate is on the sand on the front side of the sand filter.

7. The spinning pack according to claim 1, wherein a first perforated plate is on the sand on the front side of the sand filter, and a second perforated plate is between the sand filter with metal protective filter and a die plate.

8. The spinning pack according to claim 7, wherein the holes in both the first and second perforated plates are configured identically.

9. The spinning pack according to claim 7, wherein the holes in the first perforated plate on the front side of the sand have a larger outflow diameter than the holes in the second perforated plate between the sand filter with metal protective filter and the die plate.

* * * * *